US008247978B2

(12) United States Patent
Ruan et al.

(10) Patent No.: US 8,247,978 B2
(45) Date of Patent: Aug. 21, 2012

(54) ILLUMINATION DEVICE WITH A SAFETY FEATURE

(75) Inventors: Qing-Hai Ruan, Shenzhen (CN); Chin-Long Ku, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 263 days.

(21) Appl. No.: 12/623,454

(22) Filed: Nov. 23, 2009

(65) Prior Publication Data

US 2011/0057567 A1 Mar. 10, 2011

(30) Foreign Application Priority Data

Sep. 8, 2009 (CN) ..... 2009 1 0306700

(51) Int. Cl.
*H05B 37/00* (2006.01)

(52) U.S. Cl. ..... 315/119; 315/219; 315/294

(58) Field of Classification Search ..... 315/119, 315/186, 193, 205, 207, 219, 225, 291, 294, 315/297, 307

See application file for complete search history.

(56) References Cited

U.S. PATENT DOCUMENTS

| | | | | |
|---|---|---|---|---|
| 4,237,403 | A * | 12/1980 | Davis | 315/98 |
| 5,661,645 | A * | 8/1997 | Hochstein | 363/89 |
| 6,031,335 | A * | 2/2000 | Lawrence | 315/119 |
| 7,855,515 | B2 * | 12/2010 | Huang et al. | 315/185 R |
| 2006/0119181 | A1 * | 6/2006 | Namba et al. | 307/10.8 |
| 2007/0013323 | A1 * | 1/2007 | De Oto | 315/291 |
| 2009/0167196 | A1 * | 7/2009 | Wang et al. | 315/171 |
| 2011/0012530 | A1 * | 1/2011 | Zheng et al. | 315/294 |
| 2011/0109248 | A1 * | 5/2011 | Liu | 315/297 |

* cited by examiner

*Primary Examiner* — Tung X Le
(74) *Attorney, Agent, or Firm* — Altis Law Group, Inc.

(57) ABSTRACT

An illumination device includes a light source, an AC power source and a balance sensing switch. The AC power source is adapted for supplying an alternating current to the light source. The balance sensing switch is connected between the light source and the AC power source for automatically cutting off an electrical connection between the light source and the AC power source when the illumination device topples down.

15 Claims, 3 Drawing Sheets

ILLUMINATION DEVICE WITH A SAFETY FEATURE

BACKGROUND

1. Technical Field

The present disclosure relates to illumination devices, and more particularly to an illumination device which can automatically cut off a power supply thereof when the illumination device topples down.

2. Description of Related Art

Illumination devices are widely used for outdoor illumination. Illumination devices beside highways or in parks usually suffer severe environmental conditions, such as typhoon, heavy snow, or earthquake and therefore may topple down. However, when the illumination device topples down, the illumination device can not automatically cut off a power supply thereof, whereby people will get an electric shock when they touch the toppled illumination device accidentally, if there is an electric leakage in the toppled illumination device. The electric shock in the worst situation can take the people's life away.

For the foregoing reason, an illumination device which can overcome the described shortcoming is desired.

BRIEF DESCRIPTION OF THE DRAWINGS

Many aspects of the embodiment can be better understood with reference to the following drawing. The components in the drawing are not necessarily drawn to scale, the emphasis instead being placed upon clearly illustrating the principles of the present disclosure. Moreover, in the drawing, like reference numerals designate corresponding parts.

DETAILED DESCRIPTION

Figure 1:
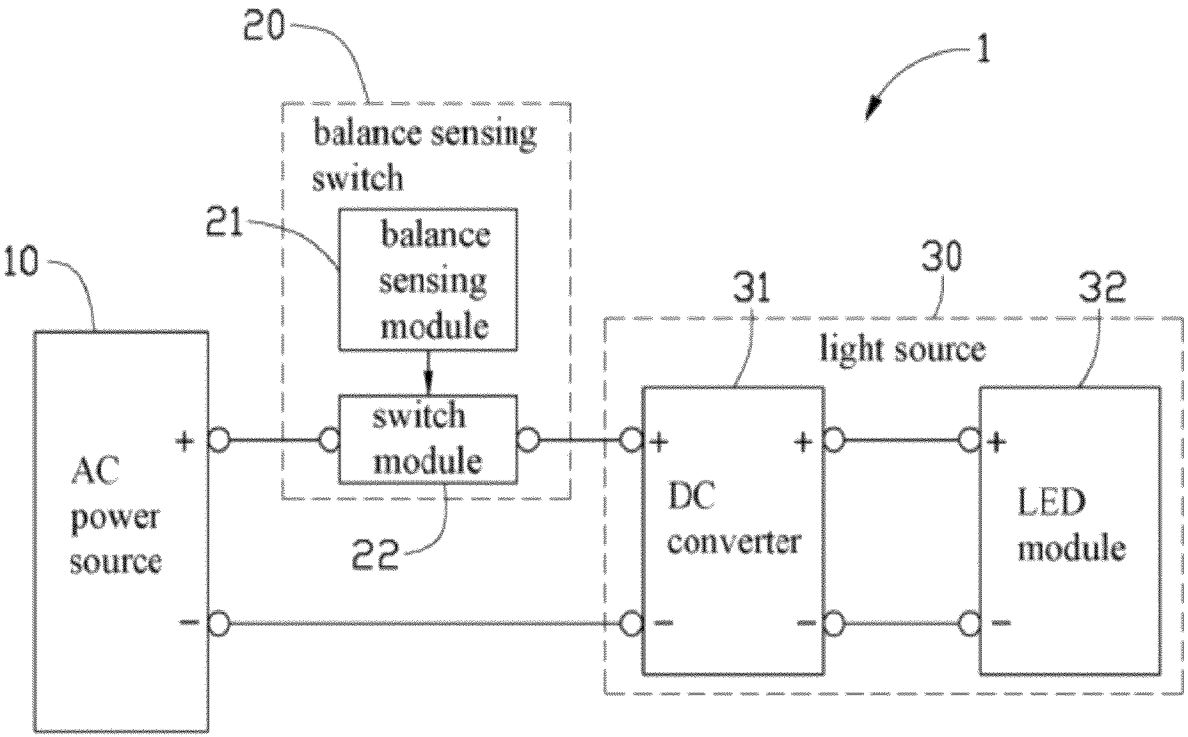
FIG. 1 is an electrical block diagram illustrating an illumination device according to an exemplary embodiment of the present disclosure.

Referring to FIG. 1, an illumination device 1 according to an exemplary embodiment of the present disclosure includes an AC (alternating current) power source 10, a balance sensing switch 20, and a light source 30 electrically connected with the AC power source 10 through the balance sensing switch 20. The light source 30 includes a DC (direct current) converter 31 and an LED module 32. The AC power source 10 supplies an alternating current to the DC converter 31 via the balance sensing switch 20. The DC converter 31 converts the alternating current to a direct current and outputs the direct current to the LED module 32. The balance sensing switch 20 senses a position status of the illumination device 1, wherein when the illumination device 1 is in a fallen position, the balance sensing switch 20 automatically cuts off an electrical connection between the AC power source 10 and the light source 30.

Figure 2:
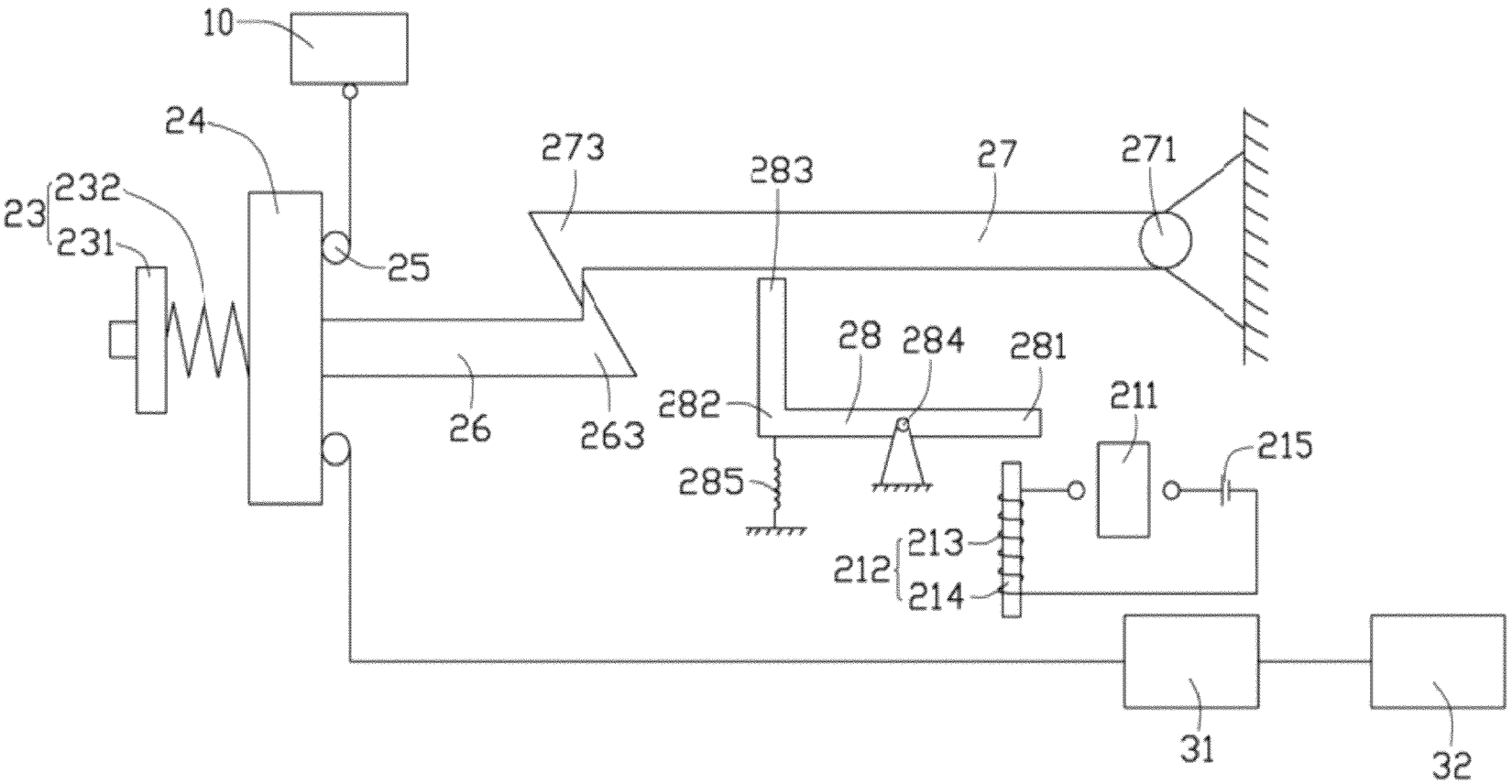
FIG. 2 is a schematic view of an inner structure of the illumination device of FIG. 1, showing an operation thereof when the illumination device is in an upright state.
Figure 3:
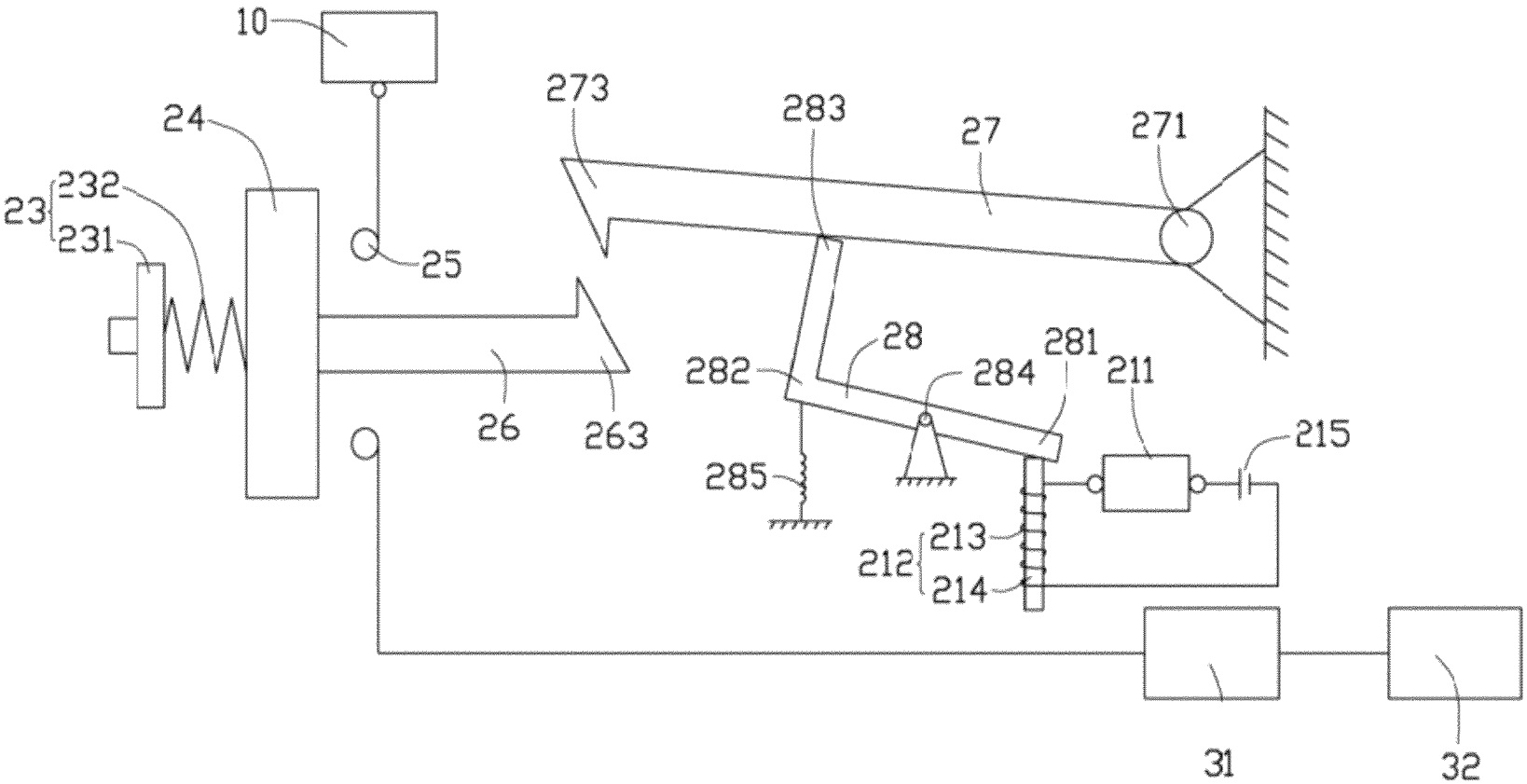
FIG. 3 is a schematic view of the inner structure of the illumination device of FIG. 1, showing an operation thereof when the illumination device is in a toppled state.

Referring to FIGS. 2 and 3, the balance sensing switch 20 includes a balance sensing module 21 and a switch module 22. When the illumination device 1 is in a fallen position, the balance sensing module 21 outputs a signal to the switch module 22 and the switch module 22 cuts off the electrical connection between the AC power source 10 and the light source 30. The balance sensing module 21 includes an electromagnet 212, a DC (direct current) power source 215 and a balance sensor 211. The electromagnet 212 includes an iron core 214 and a coil 213 wound around the iron core 214. The DC power source 215 supplies a direct current to the coil 213 of the electromagnet 212 via the balance sensor 211. The balance sensor 211 senses the position status of the illumination device 1 and controls a current supply of the DC power source 215 to the coil 213 of the electromagnet 212. Originally, the balance sensor 211 cuts off the current supply of the DC power source 215 to the coil 213 of the electromagnet 212 and the iron core 214 of the electromagnet 212 is not magnetized and accordingly not magnetic. When the illumination device 1 is changed from an upright position to a fallen position, the balance sensor 211 switches on the current supply of the DC power source 215 to the electromagnet 212 and the iron core 214 of the electromagnet 212 is therefore magnetized and accordingly magnetic.

In the present embodiment, the balance sensor 211 is a mercury switch 211, when the illumination device 1 is upright, the mercury switch 211 is vertically oriented to keep an electrical disconnection between the DC power source 215 and the coil 213. When the illumination device 1 topples down, the mercury switch 211 is horizontally oriented to trigger an electrical connection between the DC power source 215 and the coil 213.

The switch module 22 includes a manual resetting key 23, a rotatable lever 28, a first engaging arm 26, a second engaging arm 27, a movable contact tab 24, and two immovable contact nodes 25. The first engaging arm 26 includes a hook 263 formed at an end thereof. The other end of the engaging arm 26 connects with the movable contact tab 24. The rotatable lever 28 is substantially L-shaped and includes a supporting arm 281 and an operating arm 283, wherein the operating arm 283 extends perpendicularly upwardly from one end of the supporting arm 281. A fulcrum point 284 supports a middle of the supporting arm 281 so that the supporting arm 281 can rotate around the fulcrum point 284. A base of the fulcrum 284 is secured to a frame (not labeled) of the illumination device 1. The other end of the supporting arm 281 is located just above the iron core 214 of the electromagnet 212. The operating arm 283 is located just under the second engaging arm 27. A joint 282 between the supporting arm 281 and the operating arm 283 is connected to an end of a spring 285. An opposite end of the spring 285 is fixed to the frame (not labeled) of the illumination device 1. An articulated pivot 271 and a hook 273 are respectively formed at two opposite ends of the second engaging arm 27. The second engaging arm 27 is rotatable relative to the articulated pivot 271, which is fixed to the frame of the illumination device 1.

The manual resetting key 23 includes a button 231 and a spring 232. The spring 232 is connected between the button 231 and the movable contact tab 24. The manual resetting key 23 is configured to manually switch on the electrical connection between the AC power source 10 and the light source 30 when the illumination device 1 is restored from the fallen position to the upright position. More detailed description is given below.

When the illumination device 1 is originally mounted, for example, to a street post and acts as a street lamp for outdoor illumination, the mercury switch 211 is erected to isolate the current supply from the DC power source 215 to the coil 213 of the electromagnet 212, the supporting arm 281 of the lever 28 is separated from the iron core 214 of the electromagnet 212, the hook 273 of the second engaging arm 27 engages with the hook 263 of the first engaging arm 26, the movable contact tab 24 electrically contacts with the immovable nodes 25, and the AC power source 215 is electrically connected to the light source 30 through the movable contact tab 24 and the immovable nodes 25 to supply electrical power to the illumination device 1 so that the illumination device 1 can emit light. In this original state, the illumination device 1 is located in an upright position.

When the illumination device 1 topples down due to subject to a severe environmental condition, such as a typhoon, the mercury switch 211 becomes horizontal to trigger an electrical connection between the DC power source 215 and the coil 213 of the electromagnet 212. The iron core 214 of the electromagnet 212 is therefore magnetized and attracts the supporting arm 281 of the lever 28 downwardly. Then, the lever 28 rotates about the fulcrum point 284 and the operating arm 283 of the lever 28 moves upwardly to push the second engaging arm 27 upwardly to cause the hook 273 of the second engaging arm 27 to disengage from the hook 263 of the first engaging arm 26. The movable contact tab 24 is pulled outwardly by the spring 232 to disengage from the immovable nodes 25, whereby the electrical connection between the AC power source 10 and the light source 30 is automatically cut off. Thus, after the illumination device 1 topples down, people will not get an electric shock when they touch the toppled illumination device 1 accidentally.

When the toppled illumination device 1 is manually erected again, the mercury switch 211 returns to its vertical position again to cut off the electrical connection between the DC power source 215, and the coil 213 of the electromagnet 212, and the iron core 214 of the electromagnet 212 is therefore not magnetized. The supporting arm 281 of the lever 28 is pulled downwardly by the spring 285 to the horizontal position again as shown in FIG. 2, and the second engaging arm 27 also comes to a horizontal position as a result of downward movement of the supporting arm 281. The manual resetting key 23 is then pressed to drive the hook 263 of the first engaging arm 26 to engage again with the hook 273 of the second engaging arm 27, and the movable contact tab 24 electrically contacts with the immovable nodes 25, whereby the AC power source 10 is electrically connected with the light source 30 again.

It is to be understood that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illumination device comprising:

a light source adapted for getting an alternating current from an AC power source; and a balance sensing switch connected between the light source and the AC power source, the balance sensing switch automatically cutting off an electrical connection between the light source and the AC power source when the illumination device is moved from a first position for a normal use of the illumination device to a second position different from the first position;

wherein the balance sensing switch comprises a balance sensing module and a switch module, the balance sensing module outputs a signal to the switch module when the illumination device is moved from the first position to the second position, and the switch module switches off the electrical connection between the light source and the AC power source upon receiving the signal; and wherein the balance sensing module comprises an electromagnet consisting of a coil and a magnetizable core wound by the coil, a balance sensor, and a DC power source electrically connected with the coil of the electromagnet, the DC power source supplies a current to the coil of the electromagnet via the balance sensor, the balance sensor senses a position status of the illumination device and controls a current supply of the DC power source to the coil of the electromagnet.

2. The illumination device of claim 1, wherein the balance sensor is a mercury switch, the magnetizable core is an iron core, the mercury switch is erected to keep an electrical disconnection between the DC power source and the coil when the illumination device is in the first position, the mercury switch topples down to trigger the electrical connection between the DC power source and the coil when the illumination device is in the second position.

3. The illumination device of claim 1, wherein the switch module comprises a manual resetting key, a rotatable lever, a first engaging arm, a second engaging arm, a movable contact tab and two immovable nodes, the first engaging arm connects with the movable contact tab and the manual resetting key;

wherein when the illumination device is in the first position, the first engaging arm engages with the second engaging arm, the movable contact tab contacts with the immovable nodes, the AC power source supplies the alternating current to the light source through the movable contact tab and the immovable nodes; and wherein when the illumination device is in the second position, the magnetizable core of the electromagnet is magnetized by the coil through which the current of the DC power source flows, the magnetizable core of the electromagnet attracts the rotatable lever and the rotatable lever rotates to push the second engaging arm to disengage from the first engaging arm, and the movable contact tab separates from the immovable nodes, whereby the electrical connection between the AC power source and the light source is cut off.

4. The illumination device of claim 3, wherein the rotatable lever comprises a supporting arm and an operating arm connected to one end of the supporting arm, a fulcrum point supports a middle of the supporting arm, another end of the supporting arm faces to the magnetizable core of the electromagnet, the operating arm faces to the second engaging arm and connects with a spring, an articulated pivot is formed at one end of the second engaging arm; and wherein when the magnetizable core of the electromagnet is magnetized by the coil through which the current of the DC power source flows, the magnetizable core of the electromagnet attracts the supporting arm of the rotatable lever and the rotatable lever rotates about the fulcrum point, the operating arm of the rotatable lever pushes the second engaging arm to disengage from the first engaging arm.

5. The illumination device of claim 3, wherein the manual resetting key is configured to manually switch on the electrical connection between the AC power source and the light source and configured to drive the first engaging arm to engage with the second engaging arm by pushing the manual resetting key toward the second engaging arm after the first engaging arm is disengaged from the second engaging arm.

6. The illumination device of claim 1, wherein the light source comprises a DC converter and an LED module, the DC converter converts the alternating current of the AC power source to a direct current and outputs the direct current to the LED module.

7. The illumination device of claim 1, wherein a manual resetting key is connected with the balance sensing switch, the manual resetting key being configured to manually switch on the electrical connection between the AC power source and the light source after the illumination device is moved from the second position to the first position.

8. An illumination device comprising:

a light source adapted for getting an alternating current from an AC power source;

a balance sensing switch connected between the light source and the AC power source, the balance sensing switch automatically cutting off an electrical connection between the light source and the AC power source when the illumination device is moved from a first position for a normal use of the illumination device to a second position different from the first position; and a manual resetting key connected with the balance sensing switch, the manual resetting key being configured to manually switch on the electrical connection between the AC power source and the light source after the illumination device is moved from the second position to the first position.

9. The illumination device of claim 8, wherein the light source comprises a DC converter and an LED module, the DC converter converts the alternating current of the AC power source to a direct current and outputs the direct current to the LED module.

10. The illumination device of claim 8, wherein the balance sensing switch comprises a balance sensing module and a switch module connected with the balance sensing module, the balance sensing module is configured to sense the position of the illumination device, and the switch module is configured to switch off the electrical connection between the light source and the AC power source when the illumination device is in the second position.

11. The illumination device of claim 10, wherein the balance sensing module comprises an electromagnet, a DC power source, and a balance sensor connected between the electromagnet and the DC power source, the balance sensor controls a current supply of the DC power source to the electromagnet.

12. The illumination device of claim 11, wherein the balance sensor is a mercury switch, the electromagnet comprises an iron core and a coil wound around the iron core, the mercury switch topples down to trigger an electrical connection between the DC power source and the coil when the illumination device is in the second position.

13. The illumination device of claim 10, wherein the switch module comprises a rotatable lever, a first engaging arm, and a second engaging arm engaged with the first engaging arm, the rotatable lever is rotatable to cause the second engaging arm to disengage from the first engaging arm when the illumination device is in the second position.

14. The illumination device of claim 13, wherein the manual resetting key includes a button and a spring arranged between the button and one end of the first engaging arm, another end of the first engaging arm is provided with a first hook, one end of the second engaging arm is pivoted to a frame of the illumination device, another end of the second engaging arm is provided with a second hook for engaging with the first hook.

15. The illumination device of claim 14, wherein at the first position, the illumination device is upright and at the second position, the illumination topples down.

* * * * *